US008429787B2

(12) United States Patent
Maynard et al.

(10) Patent No.: US 8,429,787 B2
(45) Date of Patent: Apr. 30, 2013

(54) DUAL USE CLEANING APPARATUS AND METHOD

(75) Inventors: Raymond Eugene Maynard, Westerly, RI (US); Michael Francis St. Germain, West Warwick, RI (US); Thomas Richard Helma, Wakefield, RI (US)

(73) Assignee: ZIH Corp., Hamilton (BM)

( * ) Notice: Subject to any disclaimer, the term of this patent is extended or adjusted under 35 U.S.C. 154(b) by 871 days.

(21) Appl. No.: 12/351,821

(22) Filed: Jan. 10, 2009

(65) Prior Publication Data

US 2009/0188529 A1 Jul. 30, 2009

Related U.S. Application Data

(63) Continuation-in-part of application No. 11/460,040, filed on Jul. 26, 2006, now Pat. No. 7,882, 590.

(60) Provisional application No. 60/702,880, filed on Jul. 27, 2005.

(51) Int. Cl.
*B08B 11/00* (2006.01)

(52) U.S. Cl.
USPC ..... 15/256.52; 15/102; 399/123

(58) Field of Classification Search ..... 15/77, 102, 15/256.52; 399/123; 400/701
See application file for complete search history.

(56) References Cited

U.S. PATENT DOCUMENTS 4,009,047 A 2/1977 Lindsay
5,037,216 A 8/1991 Nubson et al.
5,349,714 A 9/1994 Korbonski et al.
5,913,345 A * 6/1999 Corrado et al. ..... 15/3
6,200,392 B1 3/2001 Korbonski
6,285,845 B1 9/2001 Liatard et al.
6,408,151 B1 6/2002 Heno
6,431,537 B1 8/2002 Meier (Continued)

FOREIGN PATENT DOCUMENTS

CN 1338382 A 3/2002
CN 1476983 A 2/2004

(Continued)

OTHER PUBLICATIONS

PCT International Search Report/Written Opinion; International Application No. PCT/US2010,020423; Apr. 28, 2010; 10 pages.

(Continued)

*Primary Examiner* — Randall Chin
(74) *Attorney, Agent, or Firm* — Alston & Bird LLP

(57) ABSTRACT

The present invention provides a cleaning assembly for use in a media processing device. In various embodiments, the cleaning assembly includes a first roller that at least partially engages a second roller, and a transport path that passes between the first roller and the second roller. There may also be a third collection roller that at least partially engages the second roller. The third collection roller may also engage a drive assembly that may be used to drive a media substrate along the transport path. In one embodiment, the second roller defines a surface adherence that is greater than a surface adherence of the first roller and the third collection roller defines a surface adherence that is greater than the surface adherence of the second roller and the drive assembly. As a result, the present invention provides a cleaning assembly capable of cleaning the drive assembly and opposed surfaces of a media substrate in a single pass.

17 Claims, 6 Drawing Sheets

U.S. PATENT DOCUMENTS

| | | | |
|---|---|---|---|
| 6,457,886 | B1 | 10/2002 | Meier |
| 6,578,841 | B2 | 6/2003 | Salomon et al. |
| 6,582,141 | B2 | 6/2003 | Meier et al. |
| 6,698,878 | B1 | 3/2004 | Roche et al. |
| 6,865,053 | B2 | 3/2005 | Bengds et al. |
| 6,902,107 | B2 | 6/2005 | Shay et al. |
| 6,985,167 | B2 | 1/2006 | Lien |
| 7,170,537 | B2 | 1/2007 | Helma et al. |
| 7,328,897 | B2 | 2/2008 | Bryant et al. |
| 2001/0055043 | A1 | 12/2001 | Wanibuchi et al. |
| 2002/0023307 | A1 | 2/2002 | Haba et al. |
| 2004/0114019 | A1 | 6/2004 | Nakashima |
| 2005/0084315 | A1 | 4/2005 | Lodwig et al. |
| 2007/0023068 | A1 | 2/2007 | Helma |
| 2007/0099462 | A1 | 5/2007 | Helma et al. |
| 2007/0143937 | A1 | 6/2007 | Squires et al. |
| 2007/0201919 | A1 | 8/2007 | Okazaki |
| 2008/0024581 | A1 | 1/2008 | Nakayama |
| 2008/0184903 | A1 | 8/2008 | Kaneoya et al. |

FOREIGN PATENT DOCUMENTS

| | | | |
|---|---|---|---|
| CN | 1704252 | A | 12/2005 |
| CN | 1816453 | A | 8/2006 |
| CN | 101054022 | A | 10/2007 |
| CN | 201140569 | Y | 10/2008 |
| DE | 10126374 | A1 | 12/2001 |
| GB | 2 230 738 | A | 10/1990 |
| JP | 59001285 | A | 1/1984 |
| JP | 59182768 | A | 10/1984 |
| JP | 03105919 | A | 5/1991 |
| JP | 2002-120446 | A | 4/2002 |
| WO | WO 2007/059417 | A1 | 5/2007 |

OTHER PUBLICATIONS

Office Action for Chinese Application No. 2010800111517 dated Jan. 23, 2013.

* cited by examiner

DUAL USE CLEANING APPARATUS AND METHOD

CROSS-REFERENCE TO RELATED APPLICATIONS

This application is a continuation-in-part of U.S. application Ser. No. 11/460,040 filed Jul. 26, 2006, now U.S. Pat. No. 7,882,590, which claims priority from U.S. Provisional Application No. 60/702,880 filed Jul. 27, 2005, both of which are hereby incorporated herein in their entirety by reference.

BACKGROUND

1. Field of the Invention

The present invention is directed to a cleaning method, assembly, and system for cleaning media substrates and feed assemblies used in media processing devices such as a printer. More specifically, various embodiments of the present invention are directed to a cleaning apparatus and method that cleans at least one surface of a media substrate while also cleaning a pick or drive mechanism that operates to drive the media substrate along a transport path.

2. Description of the Related Art

Conventional media processing devices, such as printers, and configured to process (e.g., print, encode, read, transport, etc.) media substrates such as plastic cards, paper, and the like. The media substrates may be stored in a hopper or storage bin positioned adjacent to or within the media processing device. In order for processing to occur, the media substrates are fed from the hopper into the media processing device along a media transport path by a media drive assembly.

Conventional media drive assemblies include a pick roller configured to individually engage and drive an individual media substrate from a media hopper, and/or a drive roller that is configured to transport media substrates along a media transport path. The pick or drive roller is often made from rubber or other materials in order to ensure that the roller sufficiently grips the media substrate when driving the substrate into the media processing device.

Debris such as dust, oil, moisture, ink, and the like can be introduced into the transport path and can interfere with the processing of a media substrate. For example, a media or card processing device can include a printhead that transfers dye onto the cards, a magnetic head that programs a magnetic strip on the card, a smart card contact station with an electrical contact that contacts a conductive pad on the card to communicate with a chip on the card, a laser or thermal device that images or alters the feel of the card, and/or a lamination mechanism with heat rollers that applies laminates to the surfaces of the card. The operation of each of these devices may be negatively impacted by the presence of debris on the media substrate and the quality of the final printed/encoded card can be negatively impacted.

Applicant has discovered then that it would be desirable to provide a cleaning assembly that is configured to clean at least one surface of a media substrate while also enhancing the efficient operation of a media drive assembly positioned within or adjacent to the media processing device. As described in greater detail below, a variety of challenges were identified and overcome through Applicant's efforts to invent and develop such an assembly.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

The present invention provides a cleaning assembly configured to efficiently clean at least one surface of a media substrate while also cleaning a media pick, feed, or drive assembly. In one embodiment, the cleaning assembly efficiently removes debris from both sources (e.g., the media substrate and the pick/feed/drive assembly) to a replaceable component such as an adhesive tape roller that may be mounted by itself or as part of larger component such as a replaceable ribbon cartridge.

In various embodiments, the cleaning assembly for a media processing device with a media transport path includes a first cleaning structure, a second cleaning structure, and a collection structure. The first cleaning structure defines a first cleaning surface disposed proximate a first side of the media transport path. The second cleaning structure defines a second cleaning surface disposed proximate a second side of the media transport path. The second cleaning structure is configured to at least intermittently engage the first cleaning structure. The collection structure defines a collection surface disposed in at least intermittent contact with the second cleaning structure and is also configured to at least intermittently engage a media drive assembly.

Cleaning assemblies structured according to various embodiments of the invention are illustrated in FIGS. 1-6, which are oriented in relation to coordinate axes X-Y-Z for illustration purposes. The depicted coordinate axes may be readily altered without deviating from the inventive concepts herein described and, therefore, should not be construed as limiting.

Figure 1:
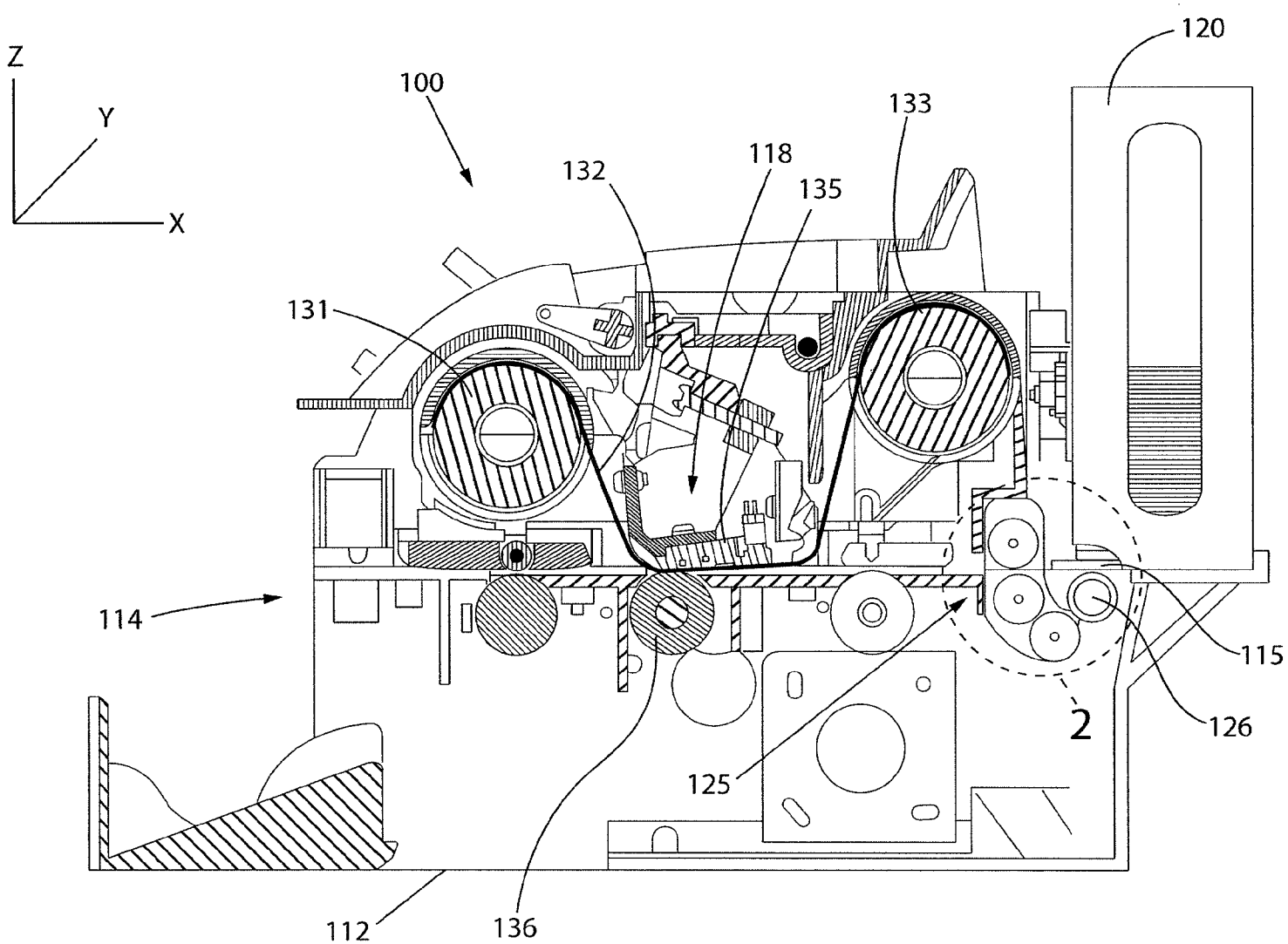
FIG. 1 is a cross section view of a printer incorporating a cleaning assembly structured in accordance with one embodiment of the present invention.

FIG. 1 illustrates a section view of a thermal transfer printer 100 incorporating a cleaning assembly structured in accordance with one embodiment of the present invention. Thermal transfer printers may be used to print information such as text, graphics, photographs, barcodes, and other indicia, onto media substrates including plastic cards such as I.D. cards, drivers' licenses, and the like. Other printers may be adapted to print to media substrates such as labels, photographic paper, standard paper, RFID tags, RFID inlets, and the like (collectively referred to as "media substrates"). As will be apparent to one of ordinary skill in the art, cleaning assemblies according to various embodiments of the present invention may be adapted for use in any media processing device where it is useful for the media substrate to be cleaned and transported or maneuvered. The foregoing specification describes the depicted thermal transfer printer 100 merely by way of example as one type of media processing device and, thus, should not be construed as limiting.

The depicted thermal transfer printer 100 includes a printer body or frame 112, a media hopper 120, a cleaning station 125, a discharge station 114, and a print station 118. Individual media substrates 115, such as PVC cards, are transported in succession from right to left, as viewed in FIG. 1, along a substantially horizontal media transport path between the media hopper 120 and the discharge station 114. The inventive concepts herein described may also be applied to other, more complex, media transport paths depending on the structure of the media processing device and the corresponding positioning of the cleaning assembly.

The depicted print station 118 includes a printhead 135 and a platen roller 136. Ribbon transfer media 132 may be played out from a ribbon cartridge supported by the printer frame 112. In operation, the ribbon transfer media 132 is drawn from a ribbon supply roll 133, between the printhead 135 and the platen roller 136, to a ribbon take-up roll 131. The ribbon cartridge (housing the ribbon supply roll 133 and ribbon take-up roll 131) is typically a removable, replaceable, unit that is disposed of by an operator when the ribbon 132 has been spent.

As will be apparent to one of ordinary skill in the art, the media hopper 120 may include a media drive assembly 126 for transporting individual media substrates from the media hopper 120 along the media transport path toward the cleaning assembly 125. In the depicted embodiment, a media substrate 115 is transferred from the media hopper 120 to the cleaning assembly 125 along the media transport path.

Figure 2:
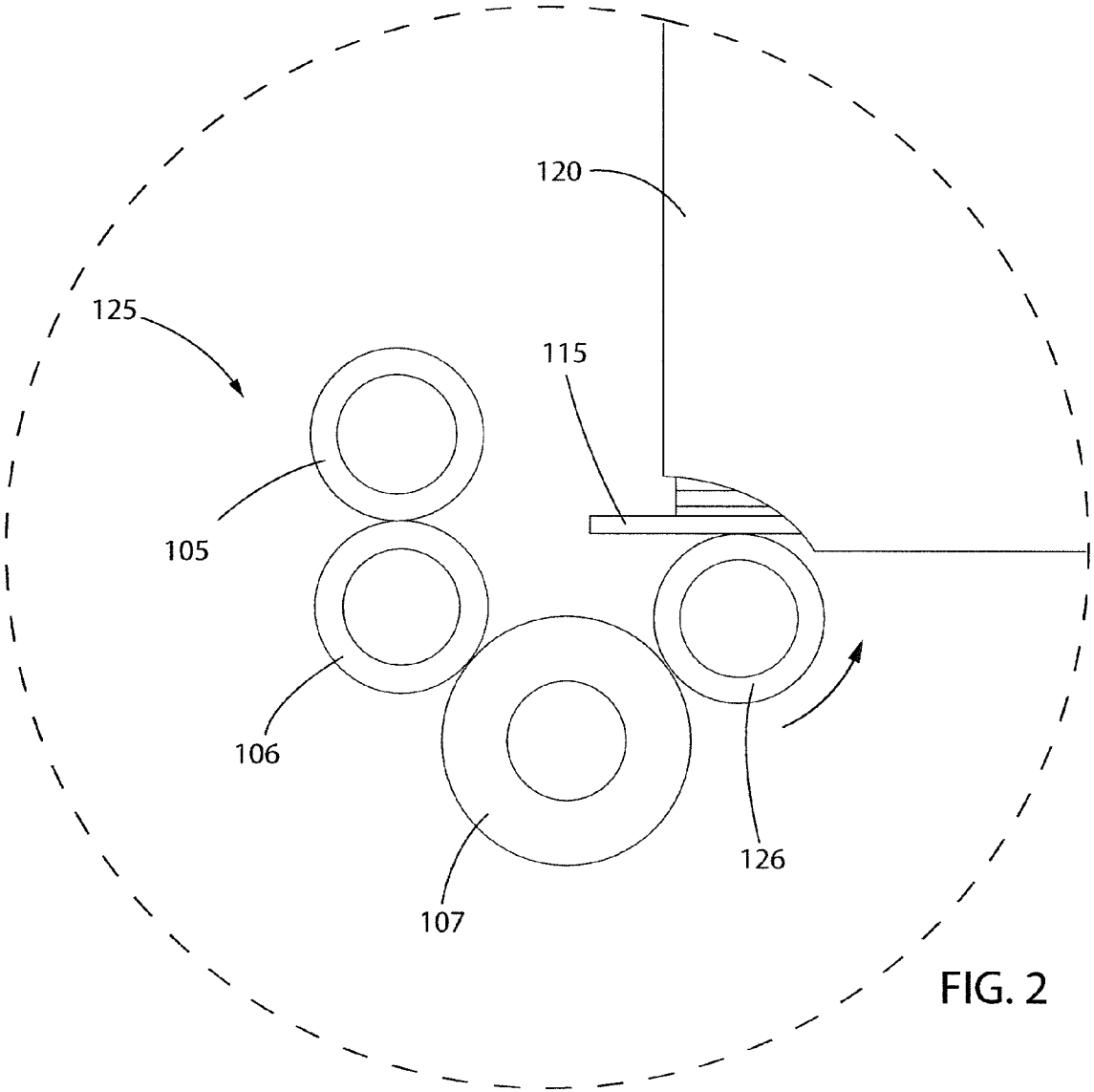
FIG. 2 is a detail view of the cleaning assembly of FIG. 1, taken along detail circle 2, in accordance with one embodiment of the invention.

In one embodiment, as shown in FIG. 2, the cleaning assembly 125 includes a first cleaning structure 105, a second cleaning structure 106, and a collection structure 107. In the depicted embodiment, the first cleaning structure 105, the second cleaning structure 106, and the collection structure 107 are comprised of cleaning rollers. The first cleaning structure 105 is configured to rotatably engage the second cleaning structure 106. The collection structure 107 is configured to rotatably engage the second cleaning structure 106. Notably, the collection structure is also configured to rotably engage the media drive assembly 126 as will be discussed in greater detail below.

Figure 3:
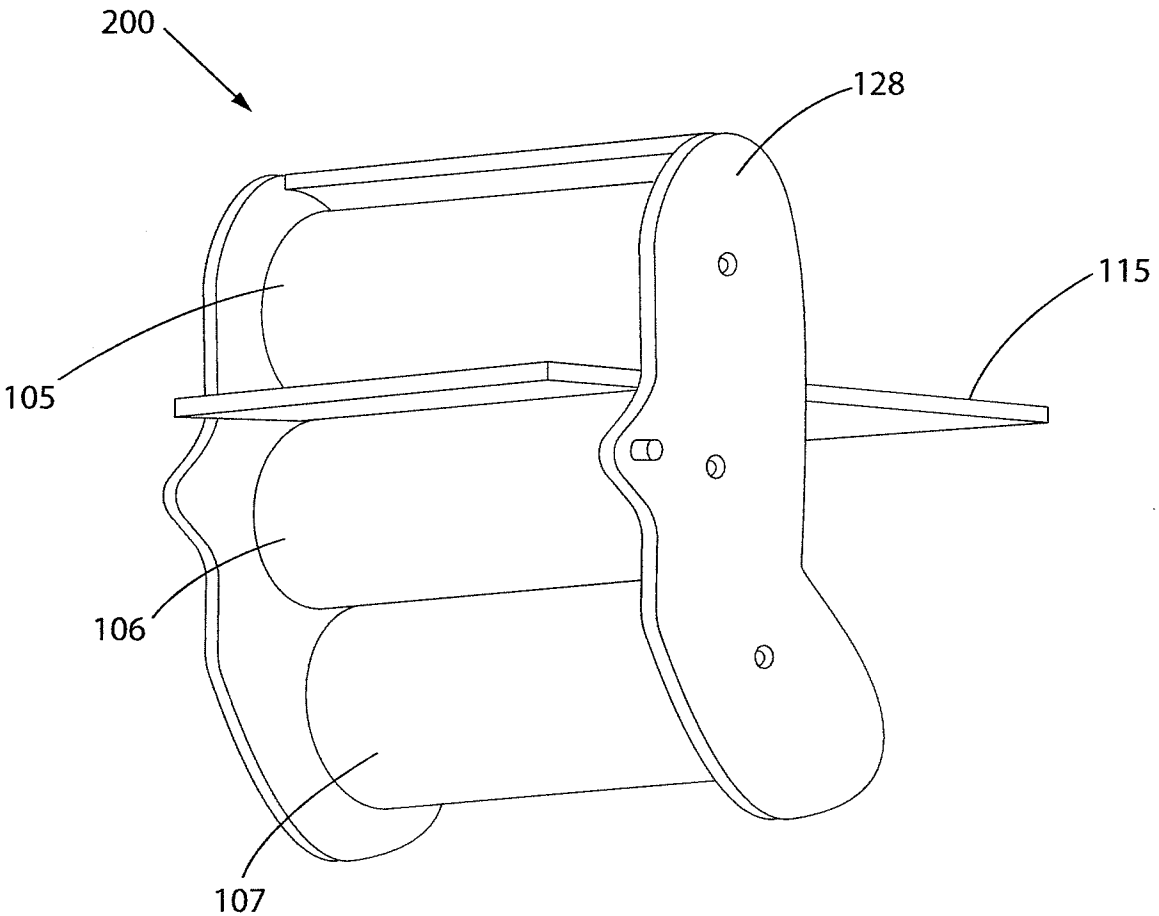
FIG. 3 is a detail view of a cleaning assembly cartridge structured in accordance with one embodiment of the invention.

In one embodiment, the first cleaning structure 105, the second cleaning structure 106, and/or the collection structure 107 may be mounted within or supported by a replaceable cleaning cartridge 128 as shown in FIG. 3. The cleaning cartridge 128 may itself be configured to allow replacement of individual elements (e.g., the first cleaning structure, the second cleaning structure, the collection structure, etc.). Additionally, the entire cleaning cartridge may be a disposable element. In still other embodiments (not shown), each of the first cleaning structure, the second cleaning structure, and the collection structure may be supported directly by the frame or structure of the printer itself. In such embodiments, each of the first cleaning structure, the second cleaning structure, and the collection structure may be individually replaced when they become worn or spent.

In the depicted embodiment, the first cleaning structure 105, the second cleaning structure 106, and the collection structure 107 are oriented such that their longitudinal axes are substantially perpendicular to the media transport path. The media drive assembly 126 is also oriented such that the longitudinal axis is substantially perpendicular to the media transport path. The media drive assembly 126 is aligned to drive the media substrate 115 from the media hopper 120 along the transport path. The first cleaning structure 105 is positioned in rolling contact with the second cleaning structure 106 and the interface, or nip, defined therebetween is aligned with the media transport path such that a media substrate 115 traveling from the media hopper 120 defines a media cleaning transport path passing between the first cleaning structure 105 and the second cleaning structure 106.

FIG. 2 is a detail view of the cleaning assembly 125 of FIG. 1, taken along detail circle 2. In the depicted embodiment, the media substrate 115 travels along the media transport path into the interface defined between the first cleaning structure 105 and the second cleaning structure 106. In one embodiment, the first cleaning structure 105, the second cleaning structure 106, and/or the collection structure 107 may be driven to rotate by one or more drive motors independent of the motion of the media substrate 115.

Figure 4:
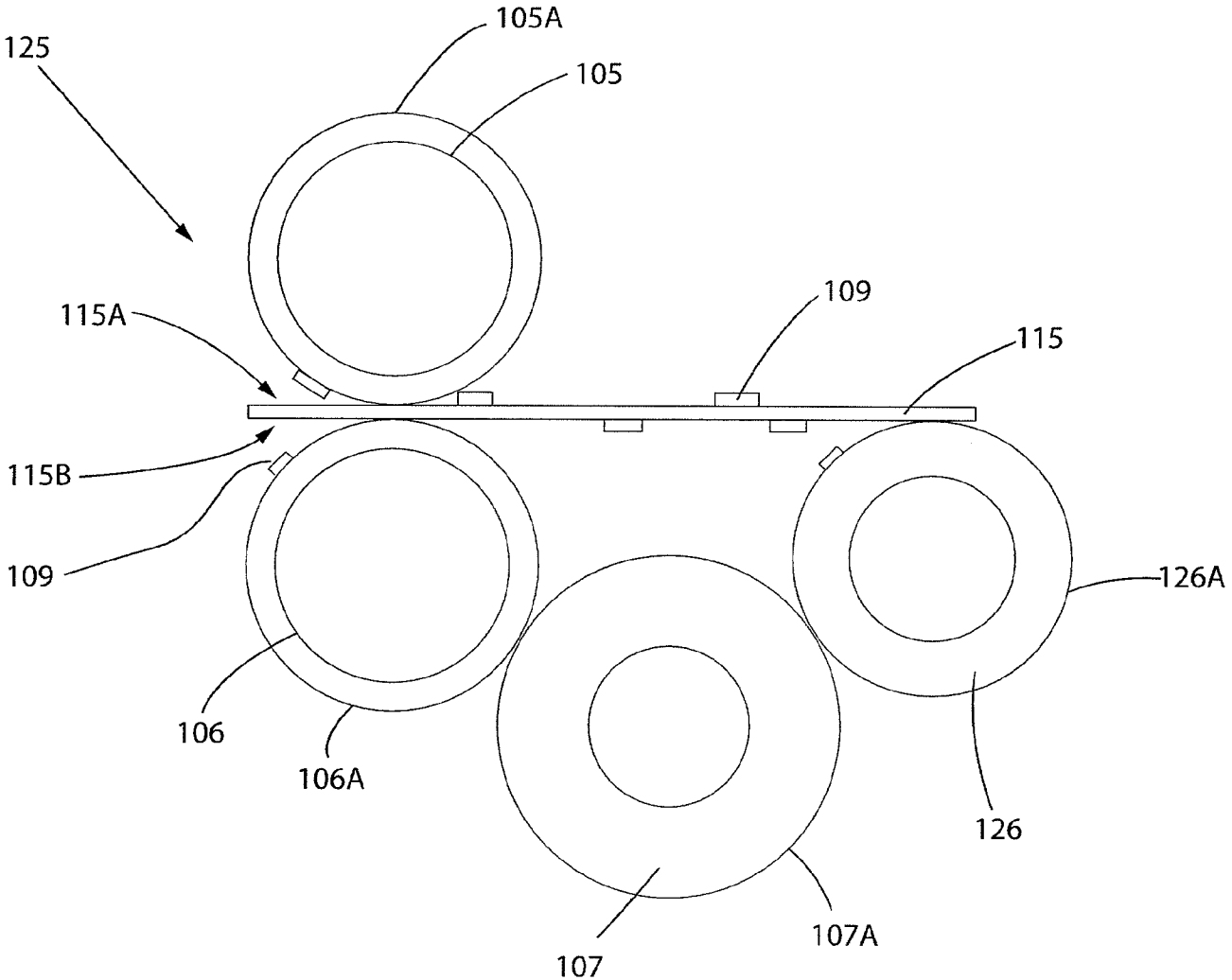
FIG. 4 is a detail view of a cleaning assembly configured to transfer debris between rollers in accordance with one embodiment of the invention.

FIG. 4 illustrates a cleaning operation in accordance with one embodiment of the present invention. In the depicted embodiment, the exterior surface of the first cleaning structure 105 defines a first cleaning structure surface 105A having a first adherence level. The exterior surface of the second cleaning structure 106 defines a second cleaning structure surface 106A having a second adherence level. The exterior surface of the collection structure 107 defines a collection structure surface 107A having a third adherence level. The media drive assembly 126 defines a drive surface 126A having a fourth adherence level.

As used in the foregoing specification and appended claims the term "adherence" refers to the ability of a surface to adhere or otherwise capture particulate, debris, oil, etc., that may be disposed on an adjacent surface. Adherence may occur after contact and under pressure, and includes, but is not limited to, tack, tackiness, adhesiveness, mechanical interaction, adhesion promoting surface deformation, and electrostatic attraction.

The relative adherence of the first cleaning structure surface 105A, the second cleaning structure surface 106A, the collection structure surface 107A, and the drive assembly surface 126A may be defined by the nature of the material used to form the rollers or alternatively, by various adhesive coatings, treatments, coverings, etc., that may be applied to the respective surfaces. For example, in one embodiment, the first cleaning structure surface 105A may be coated with nitrile and the second cleaning structure surface 106A may be coated with silicone to achieve specific adherence levels, while the collection structure surface 107A may be covered with a pre-coated adhesive tape.

Figure 5:
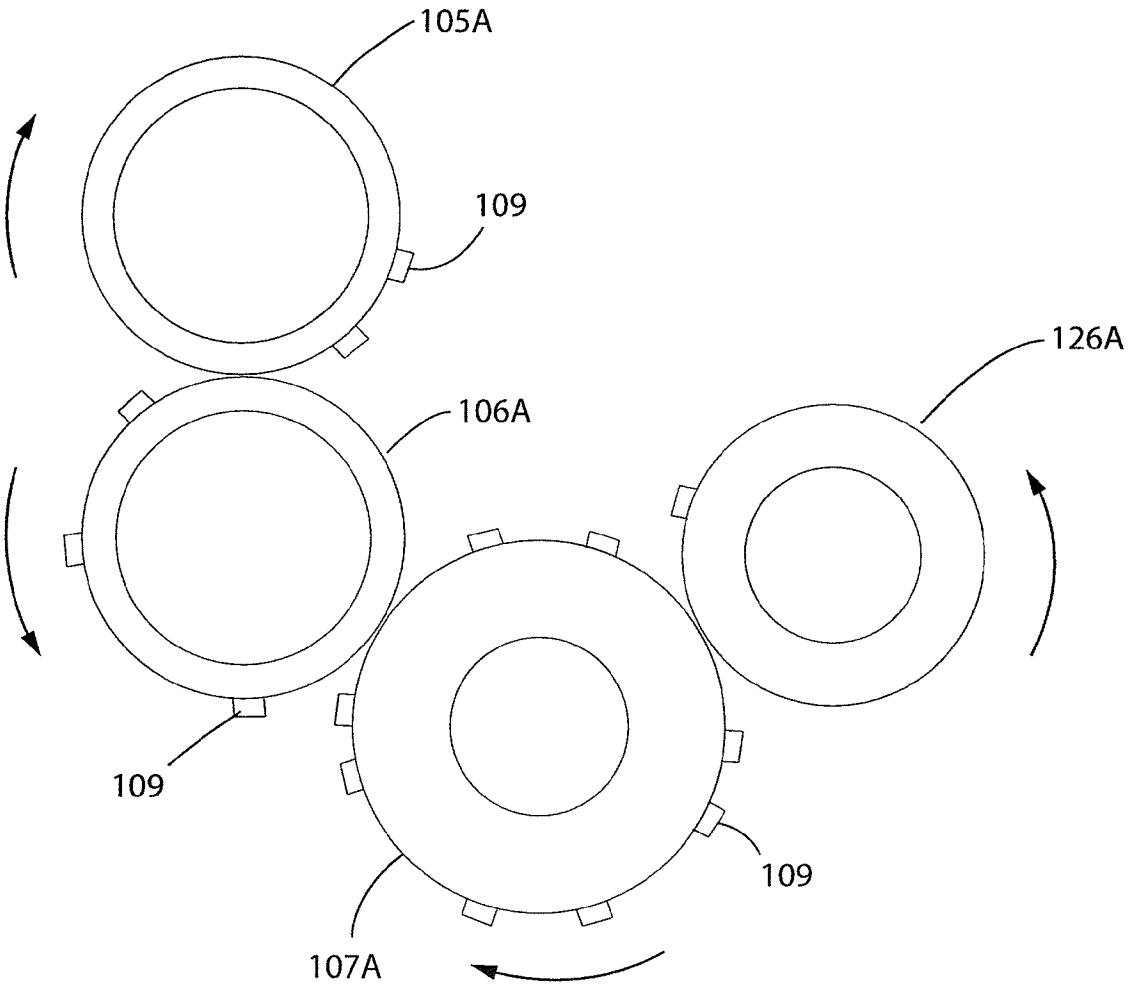
FIG. 5 is a detail view of a cleaning assembly configured to transfer debris between rollers in accordance with another embodiment of the invention.

FIGS. 4 and 5 are side detail views of the embodiment depicted in FIG. 2 as viewed along the media transport path. The depicted embodiments illustrate a removal path for dust, dirt, oil, ink, dye, and other debris (referred to collectively as debris 109) according to one embodiment of the present invention. The relative size of the debris 109 has been exaggerated for illustration purposes and should not be construed as drawn to scale.

Various media substrates including media cards 115 and the like tend to accumulate debris 109 prior to printing or other media processing operations. The debris 109 typically collects along one or more surfaces of the media substrate as shown in FIG. 4. As noted above, such debris 109 may be damaging to media processing operations and, thus, it is desirable to drive debris-containing media through a cleaning assembly 125 prior to printing or other media processing operations.

In the depicted embodiment, a debris-containing media substrate 115 is driven from the media hopper 120 through a cleaning assembly 125 in accordance with one embodiment of the present invention. As referenced above, the first cleaning structure surface 105A and the second cleaning structure surface 106A each have a surface adherence level that is greater than the relatively nominal surface adherence of the media substrate 115. The drive assembly 126 may also have a surface adherence greater than that of the media substrate 115; however, the purpose of the depicted drive assembly 126 is generally to drive the media substrate 115 from the hopper along the transport path and not to accumulate debris 109 from the media substrate 115. In other embodiments, depending on the positioning of the cleaning assembly, the drive assembly will not operate to draw media substrates from any hopper and will instead simply drive media substrates from position to position within the media processing device. For example, in one embodiment, a cleaning assembly and drive assembly could be positioned immediately upstream of a printing station to remove any debris that has collected on the media substrate during upstream media processing stations.

Since the drive assembly 126 must grip the media substrate 115 to drive it along the transport path, some level of surface adherence and/or frictional engagement is necessary and, thus, the drive assembly surface 126A may tend to accumulate debris. The second cleaning structure surface 106A has an adherence level that is greater than the adherence level of the first cleaning structure surface 105A. Likewise, the collection structure surface 107A has an adherence level that is greater than the adherence level of the second roller surface 106A and greater than the adherence level of the drive assembly surface 126A. As such, the first cleaning structure 105, the second cleaning structure 106, and the collection structure 107 create a cleaning assembly 125 wherein debris 109 is removed from one or more surfaces of the media substrate 115. The collection structure 107 also serves to remove debris from the depicted drive assembly 126 as discussed in greater detail below.

The depicted cleaning assembly 125 operates as follows: A debris-containing media substrate 115 is driven along the transport path by the drive assembly 126 and travels along the media transport path into the interface defined between the first cleaning structure 105 and the second cleaning structure 106. Some debris may incidentally adhere to the drive assembly 126. The first cleaning structure surface 105A rotatably engages a first surface 115A of the media substrate 115 thereby removing debris 109 disposed on the first surface 115A. Similarly, the second cleaning structure surface 106A rotatably engages a second surface 115B of the media substrate 115 thereby removing debris 109 that has collected on the second surface 115B.

In one embodiment, a drive motor or similar device is provided to drive the drive assembly 126. In another embodiment, a drive motor or other similar device may be provided to drive one or more of the first cleaning structure 105, the second cleaning structure 106, and the collection structure 107. Gears or other transmission systems may be used to leverage power from one or more driver motors in order to drive the drive assembly, the first cleaning structure 105, the second cleaning structure 106, and the collection structure 107.

In still other embodiments, multiple drive motors may be provided to drive any or all of the respective cleaning rollers 105, 106, 107 and the drive assembly 126. The driven structures serve to drive any idling structures of the assembly. In this regard, and in combination with the relative adherence of the cleaning rollers, the progressive cleaning assemblies of various embodiments of the present invention are adapted to be self-cleaning.

In one exemplary embodiment, as shown in FIG. 5, the respective cleaning rollers 105, 106, and 107 are adapted to perform self-cleaning during intervals defined between receiving successive media substrates 115 along the media transport path. In particular, self-cleaning occurs as the trailing edge of a media substrate 115 passes through the interface defined between the first cleaning structure 105 and the second cleaning structure 106. As the trailing edge leaves the interface, the first cleaning structure 105 continues to rotatably engage the second cleaning structure 106. As referenced above, the second cleaning structure surface 106A has an adherence level that is greater than that of the first cleaning structure surface 105A. Accordingly, debris 109 that has been temporarily collected on the first cleaning structure surface 105A will tend to be transmitted across the media transport path to the second cleaning structure surface 106A as shown.

In another embodiment, the second cleaning structure 106 is configured in rotatable engagement with a collection structure 107. The collection structure surface 107A has an adherence level that is greater than that of the second cleaning structure surface 106A and, thus, debris 109 that has collected on the second cleaning structure surface 106A is generally transferred to the collection structure surface 107A. In this regard, as will be apparent to one of ordinary skill in the art in view of the disclosure provided above, debris 109 is ultimately transferred from opposed surfaces of one or more media substrates 115 to the collection structure surface 107A.

In various embodiments, the drive assembly 126 is positioned in rotatable engagement with the collection structure 107. The collection structure surface 107A has an adherence level that is greater than that of the drive assembly surface 126A and, thus debris 109 that has collected on the drive assembly surface 126A is received by the collection structure surface 107A. Debris that transfers from the media substrate surface 115B to the drive assembly surface 126A will be deposited on the collection structure surface 107A as the surfaces 126A, 107A rotate together. Debris 109 collected by the first and second cleaning structure surfaces 105A, 106A and the drive assembly surface 126A is ultimately deposited on the collection structure surface 107A.

Collection structures configured in accordance with various embodiments of the present invention are positioned to at least intermittently engage the second cleaning structure surface and the drive assembly surface. The collection structure surfaces of such collection structures are also advantageously configured to have a greater adherence level than the respective adherence levels of the second cleaning structure surface and the drive assembly surface.

In various embodiments of the present invention, the collection structure 107 may be adapted to be removable and replaceable. In one embodiment, the collection structure 107 is provided within or supported by a replaceable ribbon cartridge as noted above. The collection structure 107 may be replaced in such embodiments individually or may be replaced when the entire ribbon cartridge is replaced. In other embodiments, the collection structure 107 may be supported within its own separately replaceable cleaning cartridge (not shown).

In still other embodiments, the collection structure 107 may be a roller comprising a plurality of layers of adhesive tape where outer layers of the tape may be removed to expose a "fresh" adhesive layer. In such embodiments, the second and/or collection structures 106, 107 may be adapted for slight repositioning to account for any change in diameter of the collection structure 107 and ensure continuing rotatable engagement between the cleaning structures and the drive assembly.

In still other embodiments, the cleaning structures 105, 106, 107 may be arranged within a removable cleaning cartridge 200 as illustrated in FIG. 3. In this regard, all three cleaning rollers may be simultaneously replaced; however, the cleaning cartridge 200 may allow each of the cleaning structures 105, 106, 107 to be individually removed and replaced.

In another embodiment of the present invention, a surface durometer or relative softness of the cleaning structures may be adapted to assist in debris removal. For example, in one embodiment, the first cleaning structure surface 105A may define a first adherence level corresponding to a durometer of the first cleaning structure surface 105A and the second cleaning structure surface 106A may define a second adherence level corresponding to a durometer of the second cleaning structure surface 106A, such that the adherence level of the second cleaning structure surface 106A is greater than the adherence level of the first cleaning structure surface 105A. In other embodiments, the collection structure surface 107A may define a third adherence level corresponding to a durometer of the collection structure surface 107A, such that the adherence level of the collection structure surface 107A is greater than the adherence level of the second cleaning structure surface 106A. In various embodiments, the drive assembly surface 126A may define a fourth adherence level corresponding to a durometer of the drive assembly surface 126A such that the adherence level of the drive assembly surface 126A is less than the surface adherence of the collection structure surface 107A.

As will be apparent to one of ordinary skill in the art in view of the disclosure provided above, the relatively firm surface of the first cleaning structure 105 will tend to transmit debris to the relatively softer surface of the second cleaning structure 106. Debris collected on the second cleaning structure 106 will then be received by the more adherent surface of the collection structure 107. Also, the relative firm surface of the drive assembly 126 will tend to transmit debris to the relatively softer surface of the collection structure 107. In this regard, debris may be systematically transferred from opposed surfaces of one or more media substrates to the collection structure surface 107A.

In one exemplary embodiment, the first cleaning structure surface 105A may be coated with nitrile having a Shore A durometer level of approximately 20, the second cleaning structure surface 106A may be coated with silicone having a Shore A durometer level of 10, the drive assembly 126 may be coated with silicone having a Shore A durometer level of approximately 20, and the collection structure surface 107A may covered with a pre-coated adhesive tape that is softer and more adherent than the drive assembly surface 126A and the second cleaning structure surface 106A. Such an embodiment encourages debris collected on the first cleaning structure 105 to be transferred to the second cleaning structure 106 and debris collected on the second cleaning structure 106 is generally transferred to the collection structure 107. Debris collected on the drive assembly 126 would also be generally transferred to the collection structure 107 as shown in FIG. 5.

Figure 6:
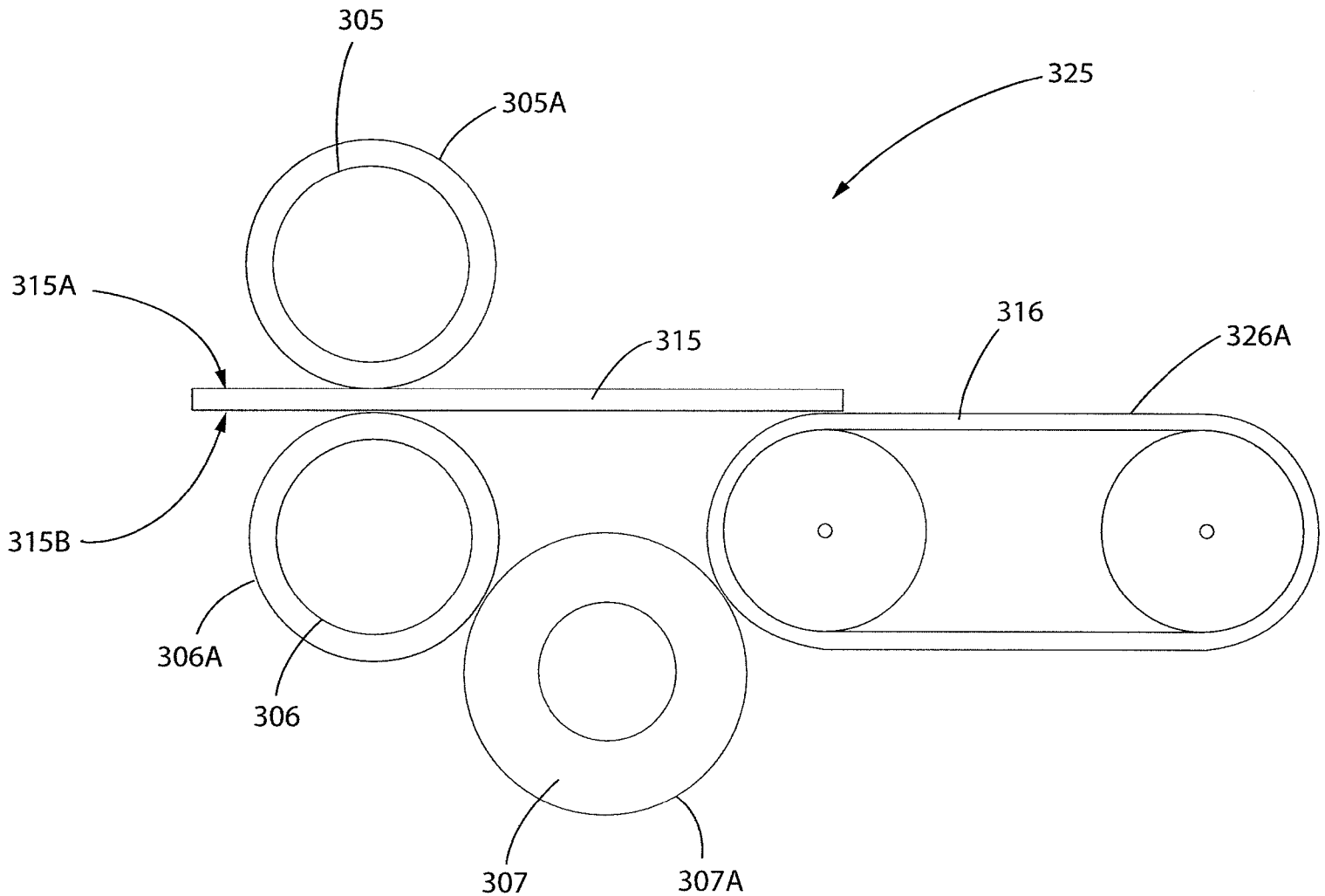
FIG. 6 is a detail view of a cleaning assembly structured in accordance with another embodiment of the invention.

It should be noted that although the structures 105, 106, 107, 126 depicted in FIGS. 1-5 are rollers, any one, any combination, or all of the structures of the present invention may comprise other structures capable of removing debris from an adjacent surface, including but not limited to cleaning belts, arcuate members, pawls, films, and pads. For example, FIG. 6 shows a cleaning assembly 325 structured to clean debris 309 from surfaces 315A and 315B of a media substrate 315 in a similar manner as that described above. In the depicted embodiment, the first cleaning structure 305, the second cleaning structure 306, and the collection structure 307 are cleaning rollers. As described above, the exterior surface of the first cleaning structure 305 defines a first cleaning structure surface 305A having a first adherence level, the exterior surface of the second cleaning structure 306 defines a second cleaning structure surface 306A having a second adherence level, and the exterior surface of the collection structure defines a collection structure surface 307A.

In the embodiment depicted in FIG. 6, the drive assembly 326 comprises a belt 316. The exterior surface of the belt 316 of the drive assembly 326 defines a drive assembly surface 326A having a fourth adherence level. In the depicted embodiment, the first cleaning structure surface 305A and the second cleaning structure surface 306A each have a surface adherence level that is greater than the relatively nominal surface adherence level of the media substrate 315, and the second cleaning structure surface 306A has an adherence level that is greater than the adherence level of the first cleaning structure surface 305A. The collection structure surface 307A has an adherence level that is greater than the adherence level of the second cleaning structure surface 306A and the surface adherence level of the drive assembly surface 326A. As such, the first cleaning structure 305, the second cleaning structure 306, the collection structure 307, and the drive assembly 326 create a cleaning assembly 325 wherein debris is removed from one or more surfaces of the media substrate 315 and subsequently transferred to the collection structure 307 consistent with the inventive concepts described above. It should be appreciated that any or all of the cleaning structures 305, 306, 307 may also be configured as a belt rather than a roller.

In various embodiments, one or more of the cleaning rollers may be adapted to pivot or otherwise translate relative to one another in order to disengage from rotatable engagement. Such translation may be appropriate, for example, where it is desired for media to periodically bypass the cleaning station. In such embodiments, the first and second cleaning structures may be adapted to selectively separate thereby allowing media to pass along the transport path without contacting the cleaning rollers. In other embodiments, the collection structure may be adapted to periodically disengage from the second cleaning structure and/or drive assembly for other purposes, for example, to reduce drag on either structure or to facilitate replacement of the collection structure.

The above described embodiments may be used on a single-pass double-sided printing assembly and cross feed media architecture, which are described in greater detail by commonly owned U.S. Provisional Patent Application No. 60/673,203, which is incorporated herein by reference. The single-pass double-sided printing assembly and cross feed media architecture is also described in U.S. application Ser. No. 11/406,548, which was filed Apr. 19, 2006, now U.S. Pat. No. 7,870,824, and is hereby incorporated by reference in its entirety.

The embodiments described above generally depict cleaning both surfaces of a media substrate in a single pass which is conducive to a media processing device that can perform processing on both sides of the media substrate without requiring a media flipping device or a second pass of the media. It should be appreciated that the inventive concepts herein described may also be applied to embodiments configured to clean only one surface of the media substrate. Such embodiments may incorporate a hard-surface, non-tacky, Teflon® coated, or otherwise low-friction roller in place of the first cleaning structure. This would prevent debris from accumulating on the low friction roller while also providing a nip positioned along the media transport path. In such an embodiment, intermittent contact between the first structure and the second, cleaning structure may not be necessary. Cleaning only one surface of the media could also provide a longer useful life for the collection structure.

Various embodiments of the present invention provide a double-sided media and drive assembly cleaning apparatus for use in a media processing device such as a printer. The cleaning assemblies of various embodiments of the present invention provide for effective and efficient cleaning of opposed surfaces of the media and the drive assembly automatically, thereby improving operation of the media processing device. The cleaning assemblies also isolate and prevent initial contamination of the transport path from dust, debris, oils, and other contaminants. Additionally, by providing a series of cleaning structures that have different levels of surface adherence, the above described cleaning assemblies transfer debris onto a replaceable component of the system, thereby providing a system that is self-cleaning with limited operator intervention.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cleaning assembly for a media processing device having a media transport path and a media drive assembly configured to drive a media substrate defining a first media substrate surface and a second media substrate surface along the media transport path, the cleaning assembly comprising:

a first cleaning structure defining a first cleaning surface disposed proximate a first side of the media transport path, wherein the first cleaning structure is positioned such that the first cleaning surface at least intermittently engages the first media substrate surface;

a second cleaning structure defining a second cleaning surface disposed proximate a second side of the media transport path, wherein the second cleaning surface is positioned to at least intermittently engage the first cleaning surface thereby defining a cleaning nip proximate the media transport path, the second cleaning structure is positioned such that the second cleaning surface at least intermittently engages the second media substrate surface; and a collection structure defining a collection surface disposed in contact with the second cleaning structure, and wherein the collection structure is positioned along the media transport path so as to engage the media drive assembly, wherein the second cleaning surface defines a second adherence level, the collection surface defines a third adherence level, and wherein the second adherence level is less than the third adherence level.

2. The cleaning assembly of claim 1, wherein the second adherence level is greater than the first adherence level.

3. The cleaning assembly of claim 2, wherein the first adherence level is greater than an adherence level of the first media substrate surface and the second adherence level is greater than an adherence level of the second media substrate surface.

4. The cleaning assembly of claim 1, wherein the collection surface defines a fifth adherence level and the media drive assembly comprises a drive assembly surface defining a sixth adherence level, and wherein the fifth adherence level of the collection surface is greater than the second adherence level of the second cleaning surface and the sixth adherence level of the drive assembly surface.

5. The cleaning assembly of claim 4, wherein the collection surface of the collection structure is configured to receive at least a portion of any debris accumulating on the first and second cleaning structures, and further configured to receive at least a portion of any debris accumulating on the drive assembly surface of the drive assembly.

6. The cleaning assembly of claim 1, wherein the collection structure comprises adhesive tape.

7. The cleaning assembly of claim 1, wherein the first cleaning structure, the second cleaning structure, and the collection structure are each independently replaceable within the media processing device.

8. The cleaning assembly of claim 1, wherein the first cleaning structure, the second cleaning structure, and the collection structure are each supported within a removable cleaning cartridge.

9. The cleaning assembly of claim 8, wherein at least one of the first cleaning structure, the second cleaning structure, and the collection structure are independently replaceable within the removable cleaning cartridge.

10. A media processing device having a media transport path and a cleaning assembly, comprising:

a first structure of the cleaning assembly defining a first surface disposed proximate a first side of the media transport path;

a second cleaning structure of the cleaning assembly defining a second cleaning surface disposed proximate a second side of the media transport path, wherein the second cleaning surface defines a second adherence level; and a collection structure defining a collection surface disposed in contact with the second cleaning structure, wherein the collection surface defines a third adherence level;

a media drive assembly disposed proximate the second side of the media transport path, wherein the collection structure engages the media drive assembly, wherein the media drive assembly defines a fourth adherence level, and wherein the third adherence level is greater than the second adherence level and the fourth adherence level.

11. The media processing device of claim 10, wherein the collection structure comprises adhesive tape.

12. The media processing device of claim 10, wherein the cleaning assembly is individually replaceable within the media processing device.

13. The media processing device of claim 10, further comprising a removable cleaning cartridge, wherein the first structure, the second cleaning structure, and the collection structure are each supported within the removable cleaning cartridge.

14. The media processing device of claim 13, wherein at least one of the first cleaning structure, the second cleaning structure, and the collection structure are independently replaceable within the removable cleaning cartridge.

15. A media processing device adapted to receive a media substrate having first and second surfaces wherein the media substrate travels along a media transport path having first and second sides, the media processing device comprising:

a drive assembly for driving a media substrate along the media transport path; and a cleaning station positioned along the media transport path, said cleaning station comprising:

a first cleaning structure disposed proximate the first side of the media transport path and configured to remove debris from the first surface of the media substrate; and a second cleaning structure disposed proximate the second side of the media transport path and configured to remove debris from the second surface of the media substrate, wherein the first and second cleaning structures are configured and positioned such that debris removed by the first cleaning structure is at least partially transmitted across the media transport path; and a collection structure configured to engage the second cleaning structure and the drive assembly such that any debris accumulating on the second cleaning structure and the drive assembly tends to be at least partially transferred to the collection structure.

16. The media processing device of claim 15, wherein the second cleaning structure is configured to at least intermittently engage the first cleaning structure.

17. The media processing device of claim 16, wherein the first cleaning structure defines a first cleaning surface defining a first adherence level, the second cleaning structure defines a second cleaning surface defining a second adherence level, the collection structure defines a collection surface defining a third adherence level, and the drive assembly defines a drive surface defining a fourth adherence level, wherein the third adherence level of the collection surface is greater than the second adherence level of the second cleaning surface and the fourth adherence level of the drive surface.

* * * * *